US008136488B2

(12) United States Patent
Haas et al.

(10) Patent No.: US 8,136,488 B2
(45) Date of Patent: Mar. 20, 2012

(54) COOLING SYSTEM FOR A VEHICLE, AND METHOD FOR THE OPERATION OF A COOLING SYSTEM

(75) Inventors: Uwe Haas, Stammham (DE); Thomas Anzenberger, Ingolstadt (DE); Thomas Reuss, Neuenstadt (DE); Gunter Zitzler, Munich (DE)

(73) Assignee: Audi AG, Ingolstadt (DE)

( * ) Notice: Subject to any disclaimer, the term of this patent is extended or adjusted under 35 U.S.C. 154(b) by 678 days.

(21) Appl. No.: 11/989,534

(22) PCT Filed: Jul. 27, 2006

(86) PCT No.: PCT/EP2006/007473

§ 371 (c)(1),
(2), (4) Date: Jan. 28, 2008

(87) PCT Pub. No.: WO2007/012493

PCT Pub. Date: Feb. 1, 2007

(65) Prior Publication Data

US 2009/0229542 A1 Sep. 17, 2009

(30) Foreign Application Priority Data

Jul. 28, 2005 (DE) ..... 10 2005 035 297
May 5, 2006 (DE) ..... 10 2006 020 951

(51) Int. Cl.
*F01P 1/06* (2006.01)

(52) U.S. Cl. ..... 123/41.29; 123/41.31

(58) Field of Classification Search ..... 123/41.29, 123/41.31, 41.32, 41.33, 568.12
See application file for complete search history.

(56) References Cited

U.S. PATENT DOCUMENTS

| | | | | |
|---|---|---|---|---|
| 4,362,131 | A | 12/1982 | Mason et al. | |
| 4,413,596 | A * | 11/1983 | Hirayama | 123/41.1 |
| 4,726,324 | A * | 2/1988 | Itakura | 123/41.1 |

FOREIGN PATENT DOCUMENTS

| | | | |
|---|---|---|---|
| DE | 3828470 | A1 | 3/1990 |
| DE | 4240239 | A1 | 6/1994 |
| DE | 4494712 | T0 | 10/1995 |
| DE | 10017434 | A1 | 10/2001 |
| DE | 101 46 313 | | 4/2003 |
| DE | 10146313 | A1 | 4/2003 |
| DE | 10210303 | A1 | 10/2003 |
| EP | 0 864 733 | | 9/1998 |
| EP | 1 055 813 | | 11/2000 |
| FR | 2 571 431 | | 4/1986 |
| JP | 56132417 | A | 10/1981 |
| JP | 59068545 | A | 4/1984 |
| JP | 63120814 | A | 5/1988 |

(Continued)

*Primary Examiner* — Noah Kamen
(74) *Attorney, Agent, or Firm* — Novak Druce + Quigg LLP

(57) ABSTRACT

An invention relates to a cooling system for a vehicle comprising an engine, an engine radiator, and an engine cooling circuit. A second cooling circuit encompassing at least one cooling component can be coupled to the engine radiator and is connected to a coolant recirculation pipe of the engine cooling circuit by means of a branch of a coolant supply pipe of the engine cooling circuit and a recirculation pipe of the cooling component. The second cooling circuit can be alternatively coupled to the coolant recirculation pipe or a coolant supply pipe at the output end in accordance with operating conditions of the engine.

13 Claims, 1 Drawing Sheet

FOREIGN PATENT DOCUMENTS

| | | | |
|---|---|---|---|
| JP | 63215860 | A | 9/1988 |
| JP | 1019156 | A | 1/1989 |
| JP | 1060760 | A | 3/1989 |
| JP | 1155020 | A | 6/1989 |
| JP | 5157006 | A | 6/1993 |
| JP | 8165925 | A | 6/1996 |
| JP | 8296437 | A | 11/1996 |
| JP | 10281016 | A | 10/1998 |
| JP | 2002021639 | A | 1/2002 |
| WO | WO9501500 | | 1/1995 |
| WO | 02081240 | A2 | 10/2002 |
| WO | WO03076776 | | 9/2003 |

* cited by examiner

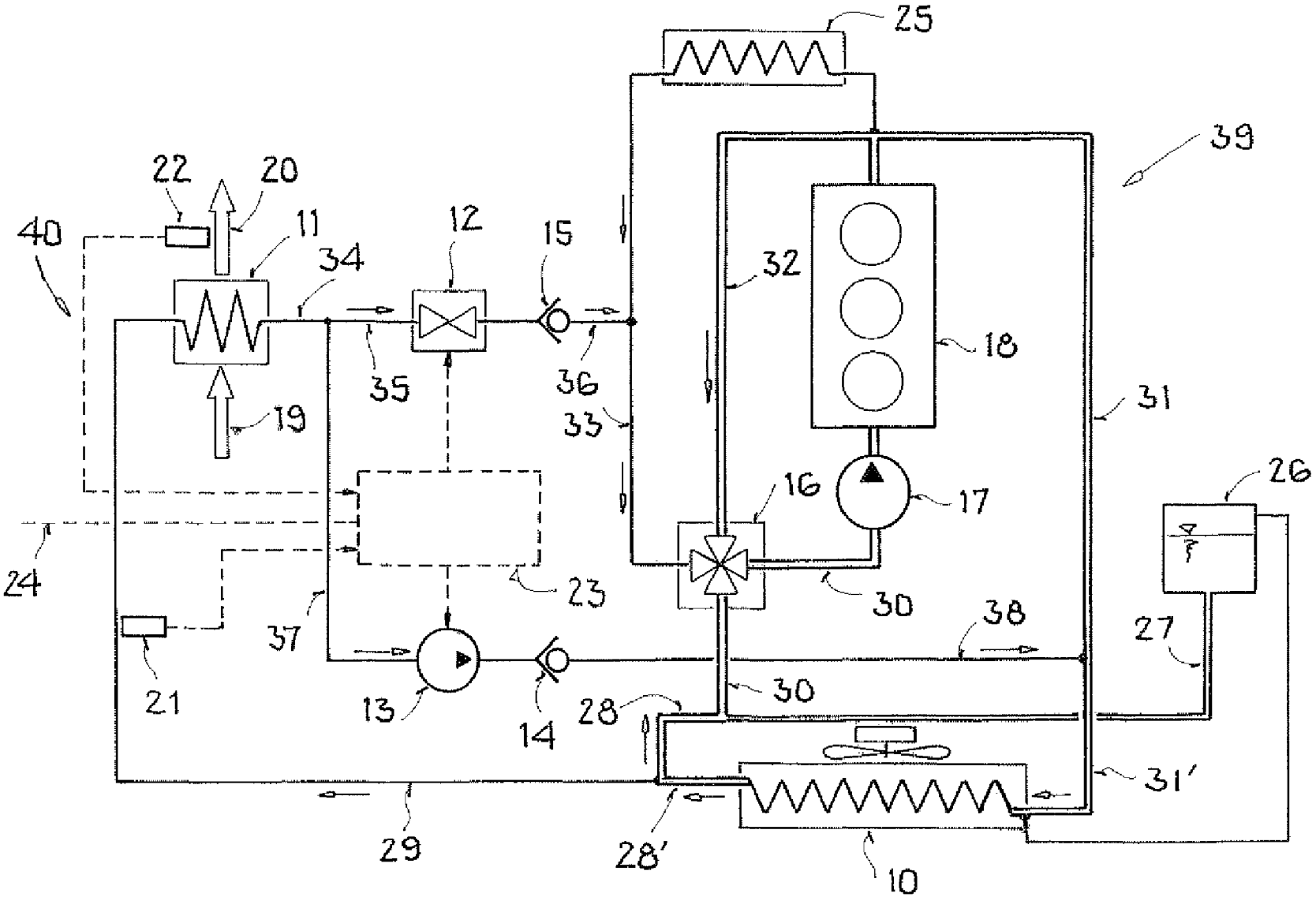
39
26
27
31
31'
18
17
38
25
30
10
32
16
30
28'
28
36
33
15
23
14
12
13
29
35
34
37
11
20
19
22
21
40
24

COOLING SYSTEM FOR A VEHICLE, AND METHOD FOR THE OPERATION OF A COOLING SYSTEM

CROSS-REFERENCE TO RELATED APPLICATIONS

This application claims priority from German Application No. DE 10 2005 035 297.9 filed Jul. 28, 2005, hereby incorporated by reference in its entirety.

The invention relates to a cooling system for a vehicle. The invention further contemplates a method for the operation of a cooling system.

BACKGROUND OF THE INVENTION

In current motor vehicle cooling systems, the coolant circulates between the components to be cooled, for example the engine, the generator, etc., and the radiator, independently of the engine load, with a relatively high, thermostat-controlled temperature of approximately 100° C., in order to minimize friction losses on the engine as much as possible. If cooling water with a much lower temperature is required to cool certain components or operating media, for example, the transmission, exhaust gas recirculation, charging air, etc., its own circuit with a separate, low temperature cooler is necessary. Often the main water radiator is structurally divided and one part is used as the low temperature cooler. On the vehicle either two radiators are installed, one high temperature radiator and one low temperature radiator, which causes installation space problems, or the main water radiator is divided into a high temperature part and a low temperature part. This division leads to problems with thermal stresses and reduces the cooling efficiency that is required for actual engine cooling.

DE 196 33 190 A 1 discloses a cooling system in which an exhaust gas cooling means is integrated into an engine cooling circuit and is connected via a branch line and a return line to the lines of the engine cooling circuit. In the engine warm-up phase the exhaust gas cooling means can be decoupled from the engine, a low temperature circuit for cooling the exhaust gas cooling means being formed. Decoupling takes place depending on the temperature using a thermostatic valve. Cooling water then circulates between the exhaust gas cooling means and the engine radiator, bypassing the engine. In the branch line, which branches off from the coolant line which leads to the engine from the engine radiator, there is a circulation pump for this purpose. The return line is routed from the cooling means into a return line which leads from the engine to the engine radiator.

The object of this invention is to devise a cooling system, based on the prior art, which makes available an improved tailor-made low-temperature circuit.

SUMMARY OF THE INVENTION

The cooling system according to the invention for a motor vehicle, as well as the method according to the invention for the operation of a cooling system, in addition to the generic features provide a second cooling circuit that can be coupled to the output side selectively to a coolant return or coolant supply line, depending on the operating conditions of the engine. Cooling of one cooling component in the second cooling circuit is ensured at all operating points of the engine. The second cooling circuit is in particular a low-temperature cooling circuit. At the same time the engine cooling circuit, for example, in the engine heat-up phase, can remain essentially unaffected by the second cooling circuit. In one operating state the second cooling circuit branches off from the coolant supply line and again couples to the coolant supply line to the engine, the second circuit being connected parallel to the coolant supply line. If the cooling circuit is switched over depending on the operating conditions, the second cooling circuit runs parallel to the engine cooling circuit, when, for example, the second cooling circuit branches off from the coolant supply line and is coupled to the coolant return. Advantageous use is made of the cooling efficiency demand on the low-temperature part and on the high-temperature part of the cooling system rarely occurring at the same time. For example, exhaust gas recirculation cooling is required only for partial loads. At many operating points, high-temperature cooling is only slightly loaded, for example, with the radiator thermostat in control operation) and can essentially be used for low-temperature cooling. Because a separate low-temperature radiator need not be used, costs and installation space are saved. Problems with thermal stresses on the engine radiator which would arise when the engine radiator is divided into a high-temperature part and a low-temperature part are also avoided. Preferably an exhaust gas recirculation cooler, a transmission oil cooler or a charge cooler can be provided as cooling components in the second cooling circuit.

In one embodiment of the invention, in the return line of the second cooling circuit there is a valve which, depending on the amount of coolant flow in the engine cooling circuit and/or the engine speed blocks or opens a connecting line between the return line and the coolant return.

In another embodiment, the valve closes automatically when a volumetric coolant flow in the engine cooling circuit and/or an engine speed is exceeded. The valve is preferably a nonreturn valve.

In still a further embodiment, upstream from the cooling component there is a first temperature measurement site and/or downstream from the exit of a medium to be cooled from the cooling component there is a second temperature measurement site. If the cooling component is, for example, an exhaust gas recirculation cooler, the temperature of the cooled exhaust gas and/or the temperature of the supplied coolant can be monitored.

In another embodiment, in the second cooling circuit there is an electric pump. The electric pump is preferably an electric circulation pump. The electric pump yields a higher delivery rate of the coolant in the second cooling circuit.

In another configuration, the electric pump is located in the branch line. Due to the arrangement of the electric pump in the branch line, the electric pump is located upstream from the cooling component. This arrangement is advantageous for reasons of space.

In a still further configuration, the electric pump is located in the return line upstream from the valve. The electric pump is therefore located downstream from the cooling component. If the delivery rate of the pump is no longer sufficient, the valve, especially a nonreturn valve, can open for a rising engine speed and thus a rising delivery rate of a motorized pump which is located in the engine cooling circuit.

In another configuration, there is a unit for monitoring and/or controlling the delivery rate of the volumetric coolant flow of the circulation pump depending on the amount of the medium to be cooled in the cooling component. The electric pump can be controlled as necessary.

In an additional configuration, there is a branch of the return of the second cooling circuit which introduces coolant into the coolant supply of the engine cooling circuit between the engine radiator and the engine. The coolant can travel, for example, into a heat return to the pump inlet in the engine cooling circuit. Supply of coolant to the cooling component in the second cooling circuit is thus ensured at all operating points.

In a still further configuration, there is a thermostatic valve for connection of the branch to the coolant supply line.

In another configuration, there is a valve, in particular an electrically actuated throttle valve or a hose thermostat which opens when the valve upstream from the pump in the return line closes.

In a more specific configuration, there is a nonreturn valve in the branch downstream from the valve.

In another configuration, there is an additional radiator between the engine radiator and the cooling component in the second cooling circuit to increase the cooling efficiency.

BRIEF DESCRIPTION OF THE DRAWINGS

Other embodiments and aspects of the invention will be detailed below using the drawings independently of the summary in the claims without limiting the general nature. Here the single FIGURE shows a schematic of the interconnection of one preferred cooling system.

DETAILED DESCRIPTION OF PREFERRED EMBODIMENT OF THE INVENTION

The cooling system shown in the FIGURE for a motor vehicle comprises an engine cooling circuit 39, in which the engine 18 is cooled, and a second cooling circuit 40 in which the cooling component 11 is cooled, for example an exhaust gas recirculation cooler.

An engine radiator 10 supplies the engine 18 with coolant via a coolant supply 28', 28 and a coolant supply 30 which is connected to it and which leads to one input of a pump 17, preferably a water pump, which is motorized and which has a delivery rate which is therefore dependent on the engine speed 18. A compensation tank 26 is connected via a supply line 27' to the engine radiator 10 or its coolant supply 28.

The coolant travels by way of the pump 17 into the engine 18 and from there via a first coolant return 31 back to the engine radiator 10 and via a second coolant return 32 to a main thermostat 16 which is located in the coolant supply 30 and which is preferably made as a double-plate thermostat. The main thermostat 16 has a connection for a short circuit line of the coolant supply 30, the radiator return 32 and a heat return 33 of a heating unit 25, to which part of the coolant heated by the engine 18 is supplied.

Coolant from the engine radiator 10 can be supplied to the second cooling circuit 40 via a branch 29 from its coolant supply 28', 28. In the branch 29, upstream from the cooling component 11 there is a first temperature measurement site 21 for detecting the coolant temperature. Hot exhaust gas 19 enters the cooling component 11 which is made preferably as an exhaust gas recirculation cooler and the cooled exhaust gas 20 emerges from the cooling component 11. The temperature of the medium cooled in the cooling component 11, for example exhaust gas, can be detected at the second temperature measurement site 22. A return line 37 branches off from the return 34.

In the second cooling circuit 40 there is a pump 13 which is made preferably as an electric circulation pump. Preferably the electric circulation pump is a water pump. For this purpose, the electric pump 13, depending on the embodiment, is located either upstream or downstream from the cooling component 11. The FIGURE shows two versions, both the arrangement upstream from the cooling component 11 in the branch line 29, and also the arrangement of the pump 13 downstream from the cooling component 11 in the return line 37 and upstream from the valve 14, the pump 13 in the version upstream from the cooling component 11 being shown with a broken line and in the version downstream from the cooling component 11 being shown with a solid line.

By preference, a valve 14 made as a nonreturn valve is located in the return line 37. If the pump 13 is located in the return line 37, it is located between the branch from the return 34 and the valve 14. A connecting line 38 leads from the valve 14 to the coolant return 31 of the engine coolant circuit 39.

Another return line 35 branches off from the return 34; in the line there is a valve 12 which is preferably made as an electrically actuatable throttle valve or as a hose thermostat. Optionally a nonreturn valve 15 can be connected to it. A connecting line 36 connects the return line 35 to the heat return 33 and thus to the coolant supply line 30.

The pump 13 receives control signals from a unit 23 for monitoring and/or controlling the delivery rate of the volumetric coolant flow of the electric pump 13. For one preferred exhaust gas recirculation cooler as the cooling component 11, for example, an exhaust gas recirculation amount 24 of the engine control, which is specific to the operating point, can be stipulated and the delivery rate of the pump 13 can be set accordingly.

The cooling component 11 requires cold coolant, for example, for cooling recirculated exhaust gas. For this purpose the coolant, preferably cooling water, is removed at the output of the engine radiator 10. If a temperature boundary value is not reached at the output of the cooling component 11, the valve 12 remains closed, and cold coolant is delivered from the pump 13 back again to the input of the engine radiator 10. A low-temperature circuit between the cooling component 11 and the engine radiator 10 is formed. A volumetric coolant flow in the low-temperature circuit, consisting of the exit region 28' of the coolant supply 28, the branch line 29, the cooling component 11, the return 34, the return line 37, the connecting line 38 and the entry region 31' of the cooling water return 31, can be matched by the unit 23 to the desired amount 24 of cooled, recovered exhaust gas which is specific to the operating point. Optionally, the delivery flow of the pump 13 flowing through the cooling component 11 can be controlled and if necessary monitored by the temperatures of the coolant at the first temperature measurement site 21 upstream from the cooling component 11 and the exhaust gas temperature at the second temperature measurement site 22 downstream from the media outlet from the cooling component 11.

The valve 12 in the return 35 results in the low-temperature cooling water not being able to adversely affect the heat-up behavior of the engine 18. As long as the engine speed remains low, the delivery rate of the pump 13 is sufficient to maintain a circulating low-temperature circuit between the cooling component 11 and the engine radiator 10. If the engine speed exceeds a boundary value, the valve 14 closes and prevents flow back through the cooling component 11. At this instant the valve 12 in the return 35 opens and enables direct coolant flow into the heat return 33 and coolant 8 supply 30 and to the pump inlet of the pump 17 upstream from the engine 10. Cooling by the cooling component 11 is thus ensured at all operating points. To further increase the cooling efficiency, optionally an additional cooler can be incorporated between the engine radiator 10 and the cooling component 11.

REFERENCE SYMBOL LIST

10 engine radiator
11 cooling component

12 valve
13 pump
14 valve
15 nonreturn valve
16 main thermostat
17 motorized pump
18 engine
19 exhaust gas upstream from the cooling component
20 exhaust gas downstream from the cooling component
21 temperature measurement site downstream from the cooling component
22 temperature measurement site upstream from the cooling component
23 monitoring unit
24 exhaust gas recirculation amount of the engine control which is specific to the operating point
25 heating unit
26 tank
27 supply line
28 coolant supply line
28' exit region from engine radiator
29 branch
30 coolant supply line
31 radiator return
31' entry region into engine radiator
32 radiator return
33 heat return
34 return
35 branch
36 connecting line
37 return line to the electric pump
38 connecting line
39 engine cooling circuit
40 second circuit

The invention claimed is:

1. A cooling system for a vehicle comprising:

a first circuit including an engine, a radiator and a first pump;

a second circuit including a heat exchanger in an exhaust gas recirculation line and a second pump, having ends connected to the supply and return segments of said first pump and engine of said first circuit; and a diverter line interconnecting said second circuit with said supply segment of said first pump and engine of said first circuit, including a first valve operable responsive to a selected operational condition of said engine.

2. A cooling system according to claim 1 including a second valve in said second circuit disposed between said second pump and said return segment of said first circuit, operable responsive to one of a volumetric coolant flow in said second circuit and a selected engine speed.

3. A cooling system according to claim 2 wherein said second pump is electrically operated.

4. A cooling system according to claim 3 wherein said second pump is located downstream of said heat exchanger.

5. A system according to claim 3 including means for at least one of monitoring and controlling the supply rate of volumetric coolant flow of said second pump responsive to the amount of medium to be cooled in said heat exchanger.

6. A cooling system according to claim 2 wherein said first valve in said diverter line is operable to open upon closure of said second valve of said second circuit.

7. A cooling system according to claim 1 wherein said second valve is operable to close upon an excess of at least one of a volumetric coolant flow and an engine speed.

8. A cooling system according to claim 1 including means for selectively connecting said diverter line to said supply segment of said first circuit.

9. A cooling system according to claim 8 including a thermostatic valve operable to selectively connect said diverter line with one of said supply and return segments of said first circuit.

10. A cooling system according to claim 8 including a nonreturn valve in said diverter line, downstream of said first valve.

11. A cooling system according to claim 1 including an additional radiator in said first circuit between said first mentioned radiator and said heat exchanger.

12. A method of operating a cooling system of a motor vehicle provided with a first circuit including an engine, a radiator and a first pump, and a second circuit including a heat exchanger in an exhaust gas recirculation line and a second pump, having ends connected to the supply and return segments of said first circuit, comprising selectively connecting said second circuit with one of said supply and return segments of said first pump and engine of said first circuit responsive to predetermined operating conditions of said engine.

13. The method of claim 12 including setting the volumetric coolant flow of said second circuit dependent upon a selected amount of medium to be cooled by said heat exchanger.

* * * * *